US011512833B1

(12) United States Patent
Joseph et al.

(10) Patent No.: US 11,512,833 B1
(45) Date of Patent: Nov. 29, 2022

(54) SYSTEM FOR PROJECTING LIGHT ELEMENTS GENERATED FROM LIGHT OF A LASER

(71) Applicant: Disney Enterprises, Inc., Burbank, CA (US)

(72) Inventors: Daniel M. Joseph, Winter Garden, FL (US); Jessica Klouda, Winter Garden, FL (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 17/650,525

(22) Filed: Feb. 9, 2022

(51) Int. Cl.

| | |
|---|---|
| ***F21S 41/176*** | (2018.01) |
| ***F21V 7/00*** | (2006.01) |
| ***F21V 7/04*** | (2006.01) |
| ***F21K 9/68*** | (2016.01) |
| ***F21K 9/65*** | (2016.01) |
| ***F21V 14/02*** | (2006.01) |
| *F21Y 101/00* | (2016.01) |

(52) U.S. Cl.
CPC ..... *F21V 7/0025* (2013.01); *F21K 9/65* (2016.08); *F21K 9/68* (2016.08); *F21V 7/04* (2013.01); *F21V 14/02* (2013.01); *F21Y 2101/00* (2013.01)

(58) Field of Classification Search
None
See application file for complete search history.

(56) References Cited

U.S. PATENT DOCUMENTS

| | | | | |
|---|---|---|---|---|
| 8,894,216 | B2 | 11/2014 | Reichow et al. | |
| 2013/0278900 | A1* | 10/2013 | Hertel | F21S 43/30 353/121 |
| 2020/0357972 | A1* | 11/2020 | Lutgen | G02B 27/0172 |

* cited by examiner

*Primary Examiner* — Elmito Breval
(74) *Attorney, Agent, or Firm* — Onyx IP Group

(57) ABSTRACT

A system, comprising a light source configured to emit light; and a first component including a reflective surface configured to reflect the light as a plurality of light elements that are reflected onto a second component. The reflective surface may include a plurality of mirrors. Each mirror, of the plurality of mirrors, may be configured to reflect a portion of the light as a respective light element of the plurality of light elements. A first light element, of the plurality of light elements, may be reflected onto a first location of the surface. A second light element, of the plurality of light elements, may be reflected onto a second location, of the surface, that is different than the first location.

20 Claims, 6 Drawing Sheets

600

SYSTEM FOR PROJECTING LIGHT ELEMENTS GENERATED FROM LIGHT OF A LASER

BACKGROUND

A laser is a device that emits light through a process of optical amplification. The process of optical amplification may be based on a stimulated emission of electromagnetic radiation. Unlike other sources of light, a laser produces a narrow beam of light by way of spatial coherence. The narrow beam may be utilized in different applications.

SUMMARY

In some implementations, a system includes a laser light source configured to emit light; a first reflective component configured to reflect the light, emitted by the laser light source, as reflected flight; and a second reflective component configured to reflect the reflected light as a plurality of light elements that are reflected onto a display surface, wherein the second reflective component includes a plurality of mirrors, wherein each mirror, of the plurality of mirrors, is configured to reflect a portion of the reflected light as a respective light element of the plurality of light elements, wherein a first light element, of the plurality of light elements, is reflected onto a first location of the display surface, and wherein a second light element, of the plurality of light elements, is reflected onto a second location, of the display surface, that is different than the first location.

In some implementations, a system includes a light source configured to emit light; and a first component including a reflective surface configured to reflect the light as a plurality of light elements that are reflected onto a second component, wherein the reflective surface includes a plurality of mirrors, wherein each mirror, of the plurality of mirrors, is configured to reflect a portion of the light as a respective light element of the plurality of light elements, wherein a first light element, of the plurality of light elements, is reflected onto a first location of the surface, and wherein a second light element, of the plurality of light elements, is reflected onto a second location, of the surface, that is different than the first location.

In some implementations, a system includes a light source configured to emit light; and a first component configured to reflect the light as a plurality of light elements that are reflected onto a second component, wherein the first component includes a plurality of reflective components, wherein each reflective component, of the plurality of reflective components, is configured to reflect a portion of the light as a respective light element of the plurality of light elements, wherein a first light element, of the plurality of light elements, is reflected onto a first location on the second component, and wherein a second light element, of the plurality of light elements, is reflected onto a second location, on the second component, that is different than the first location.

DETAILED DESCRIPTION

Figure 1:
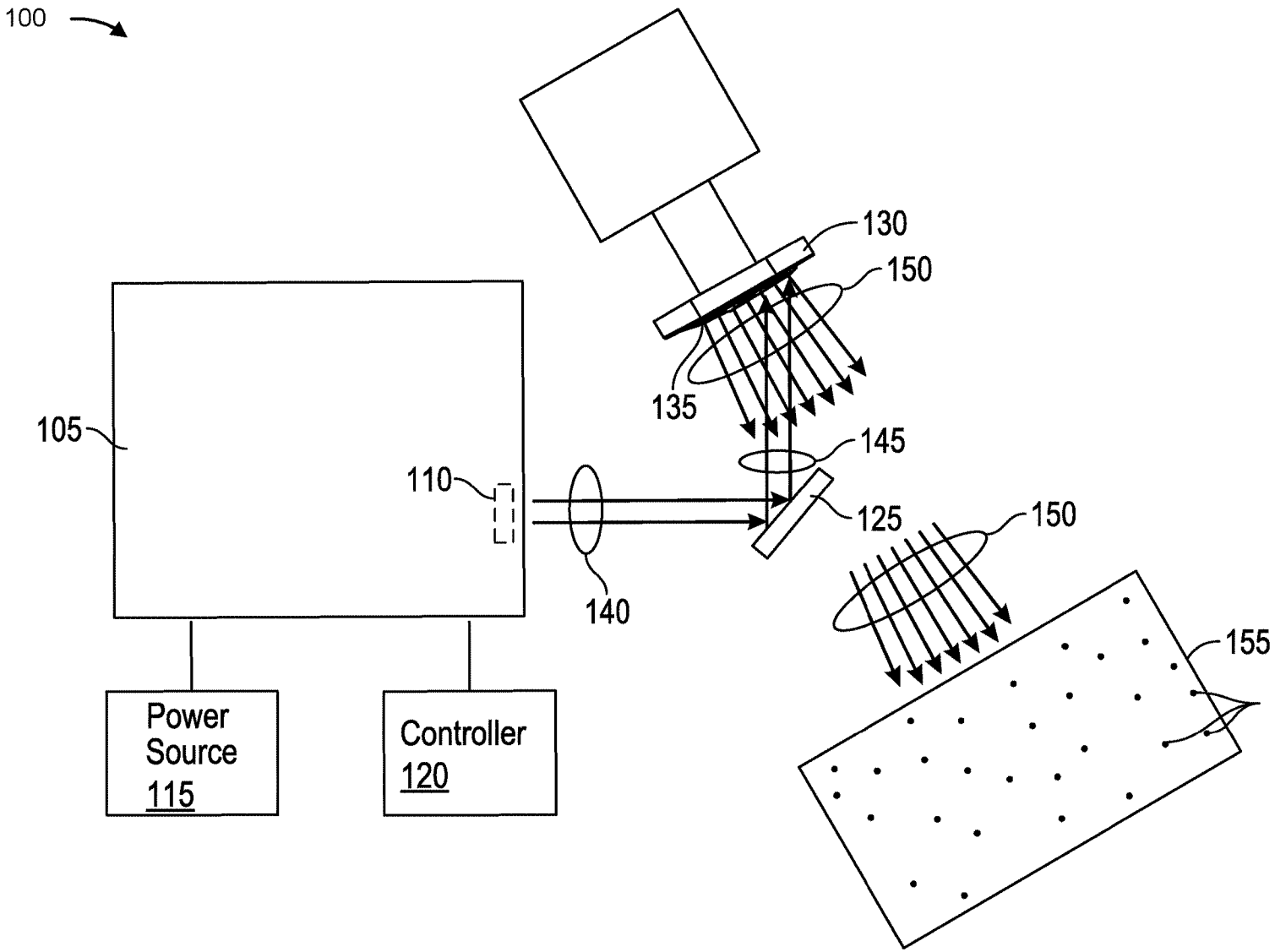
FIG. 1 is a diagram of an example system described herein.

The following detailed description of example implementations refers to the accompanying drawings. The same reference numbers in different drawings may identify the same or similar elements.

Special lighting and visual effects may be provided at a venue. The special lightning and visual effects may include star fields, flashing lights, moving light streams, randomly moving lights, simulated stars of a night sky, among other examples. In some situations, a video projector may be used to provide the special lighting and visual effects. Such video projector is typically very expensive and may require a reconfiguration in order to achieve desired lighting and visual effects. Such reconfiguration may be performed using one or more computing devices and may consume computing resources, storage resources, network resources, among other examples.

Additionally to being expensive and requiring a reconfiguration, the video projector may not be capable of covering large spaces at the venue. Furthermore, the venue may not have a sufficient amount of space and support structures to accommodate a size of the video projector. Additionally, the video projector typically projects light onto a large surface rather than a small pin point or subset of an overall projection area. Projecting light in this manner creates video black issues (e.g., when "dark" areas are undesirably subject to light provided by the video projector). Such video black issues may negatively affect the desired special lightning and visual effects.

An alternative solution to the video projector may be a laser in combination with diffraction grating. The combination of the laser and the diffraction grating may be referred to as herein "diffraction grating based laser." One issue with a diffraction based laser is the inability to support a red-green-blue (RGB) application. For example, emitting light of an RGB mixed laser (e.g., a mixed RGB beam) through a diffraction grating may not result in an output that comprises mixed colors. Instead, the output may separate red, green, and blue colors. Another issue with the diffraction based laser is that the output (e.g., a dot pattern) is geometric and not random. In other words, the diffraction based laser cannot generate random patterns.

Implementations described herein are directed to a system that reflects light, emitted by a light source, into a plurality of light elements. For example, the system may include the light source and a reflective component that is configured to reflect the light emitted by the light source. In some examples, the light source may include an RGB laser that is fully RGB controllable. For example, the system may include a controller configured to control wavelengths of each component of RGB light emitted by the RGB laser. In other words, the RGB laser may be controlled (e.g., using a controller) to generate light elements of different desired colors (e.g., other than red, green, and blue) in a precise manner.

In some examples, the reflective component may include a convex reflective surface with a plurality of mirrors (e.g., a micro mirror ball). In this regard, when the RGB laser is directed at the reflective component and emits light (e.g., a one inch light beam), the plurality of mirrors reflects the light as a plurality of light elements. In other words, the reflective component breaks up the single laser beam into a plurality of light beams. The reflective component may generate hundreds of light elements. Breaking up the laser beam into the plurality of light elements may reduce an amount of energy of each light element. Accordingly, each light element (e.g., each light beam) may be classified as a Class 1 laser due the reduced amount of energy of the light element.

The system may further include a component configured to animate the plurality of light elements. For example, the component may include a disk includes a plurality of openings. One or more of the plurality of openings may have a different shape. The disk may be configured to rotate to randomly block the plurality of light elements and to enable the plurality of light elements to pass through the disk, thereby simulating a blinking effect and/or a moving effect with respect to the plurality of light elements. The disk may be configured to maintain a measure of brightness and a measure of quality of a coherent laser light beam.

The system may further include another reflective component configured to cause the plurality of light elements to appear to be arranged in a random pattern (as opposed to the geometric pattern generated by the diffraction based laser). For example, the other component may include a concave surface with a plurality of mirrors. The plurality of light elements (from the micro mirror ball) may be reflected by the concave surface to arrange the plurality of elements in an apparently random pattern. A shape, a size, and a design of the reflective components of the system may be configured in order to generate (alone or in combination with the rotating disk) different special effects of different shapes, sizes, patterns, among other examples. For example, the system may be configured to generate star fields, fireflies, pixie dust, among other examples.

FIG. 1 is a diagram of an example system 100 described herein. As shown in FIG. 1, system 100 may include a light source 105, a first reflective component 125, and a second reflective component 130. Light source 105 may include one or more devices configured to emit light via an opening 110 of a housing of light source 105. In some examples, light source 105 may include an RGB laser and the light may include RGB light. Light source 105 may be connected to a power source 115 and a controller 120. Power source 115 may include one or more devices configured to provide power to light source 105. For example, power source 115 may include a battery, an alternating current (AC) power supply, a direct current (DC) power supply, a motion-based energy source, among other examples.

Controller 120 may include one or more devices configured to control an operation of light source 105. For example, controller 120 may be configured to control wavelengths of each component of the RGB light emitted by the RGB laser. For instance, controller 120 may be configured to cause a first component (of the RGB light) to be a first wavelength, cause a second component (of the RGB light) to be a second wavelength, among other examples. For ease of understanding, the present specification refers to each component as a single wavelength, but it should be understood that practical devices produce a range of wavelengths that are perceived as a single color. By combining RGB components with specific intensity or energy magnitude, controller 120 may cause the RGB laser to provide a wide range of colors with different wavelengths (e.g., various colors in addition red, green, and blue). In other words, the RGB laser may be fully RGB controllable. In some implementations, controller 120 may include or be implemented by a digital multiplex (DMX) controller (e.g., a controller that operates in accordance with DMX protocol).

In some implementations, a surface of first reflective component 125 may include a mirror. Additionally, or alternatively, the surface of first reflective component 125 may include a different reflective material configured to reflect light. In some implementations, second reflective component 130 may include a convex reflective surface. The convex reflective surface may include a mirror assembly 135. Mirror assembly 135 may include a plurality of mirrors. In other words, the plurality of mirrors may be part of mirror assembly 135. Mirror assembly 135 may be configured to reflect light as a plurality of light elements.

In some examples, each mirror (of the plurality of mirrors) may have a same shape (e.g., a square shape, a rectangular shape, a circular shape, among other examples). Additionally, or alternatively, each mirror (of the plurality of mirrors) may have a same size (e.g., a same height, a same width, among other examples). As an example, each mirror (of the plurality of mirrors) may have a height and/or a width of 0.5 mm. The above dimension is merely provided as an example. Other dimensions may be utilized different situations. In some examples, each mirror (of the plurality of mirrors) may have a different shape and/or a different size. In some situations, one or more of the plurality of mirrors may be laser cut mirrors.

As shown in FIG. 1, light source 105 may be directed toward first reflective component 125. Second reflective component 130 may be directed toward first reflective component 125. As shown in FIG. 1, light source 105 may emit light 140. In some examples, light 140 may be a beam of coherent light emitted by the laser. In some instance, the beam of coherent light may be a one inch light beam. The above dimension is merely provided as an example. Other dimensions may be utilized different situations. Controller 120 may cause light source 105 to provide light 140 a wide range of colors with different wavelengths, as explained above. First reflective component 125 may receive light 140 and reflect light 140 as reflected light 145.

Second reflective component 130 may receive reflected light 145. In turn, second reflective component 130 may reflect reflected light 145 as light elements 150. For example, the plurality of mirrors (of mirror assembly 135) may reflect incoming reflected light 145 as light elements 150 (referred to herein individually as "light element 150," and collectively as "light elements 150"). In this regard, the plurality of mirrors may break up reflected light 145 (e.g., reflected from the beam of coherent light) into light elements 150. Breaking up reflected light 145 in this manner may reduce an amount of energy of each light element 150. Accordingly, each light element 150 may be classified as a Class 1 laser due the reduced amount of energy of the light element 150.

As shown in FIG. 1, light elements 150 may be reflected onto a display surface 155 (e.g., a wall, a scrim, a sheet of material, among other examples). Display surface 155 does not need to be planar and may have a simple or complex curve, or crumpled manifold surface in that one advantage of using laser light source is the light remains in focus at a wide range of distances. One or more light elements 150 may be reflected onto different locations on display surface 155 as light points 160. For example, a first light element 150 may be reflected onto a first location of display surface 155; a second light element 150 may be reflected onto a second location, of display surface 155, that is different than the first location; and so on. Additionally, or alternatively, to one or more light elements 150 being reflected onto different locations, the one or more light elements 150 may have different sizes (e.g., when the plurality of mirrors have different sizes).

The number and arrangement of devices shown in FIG. 1 are provided as an example. In practice, there may be additional devices, fewer devices, different devices, or differently arranged devices than those shown in FIG. 1. Furthermore, two or more devices shown in FIG. 1 may be implemented within a single device, or a single device shown in FIG. 1 may be implemented as multiple, distributed devices. Additionally, or alternatively, a set of devices (e.g., one or more devices) of the example component may perform one or more functions described as being performed by another set of devices of the example component.

Figure 2:
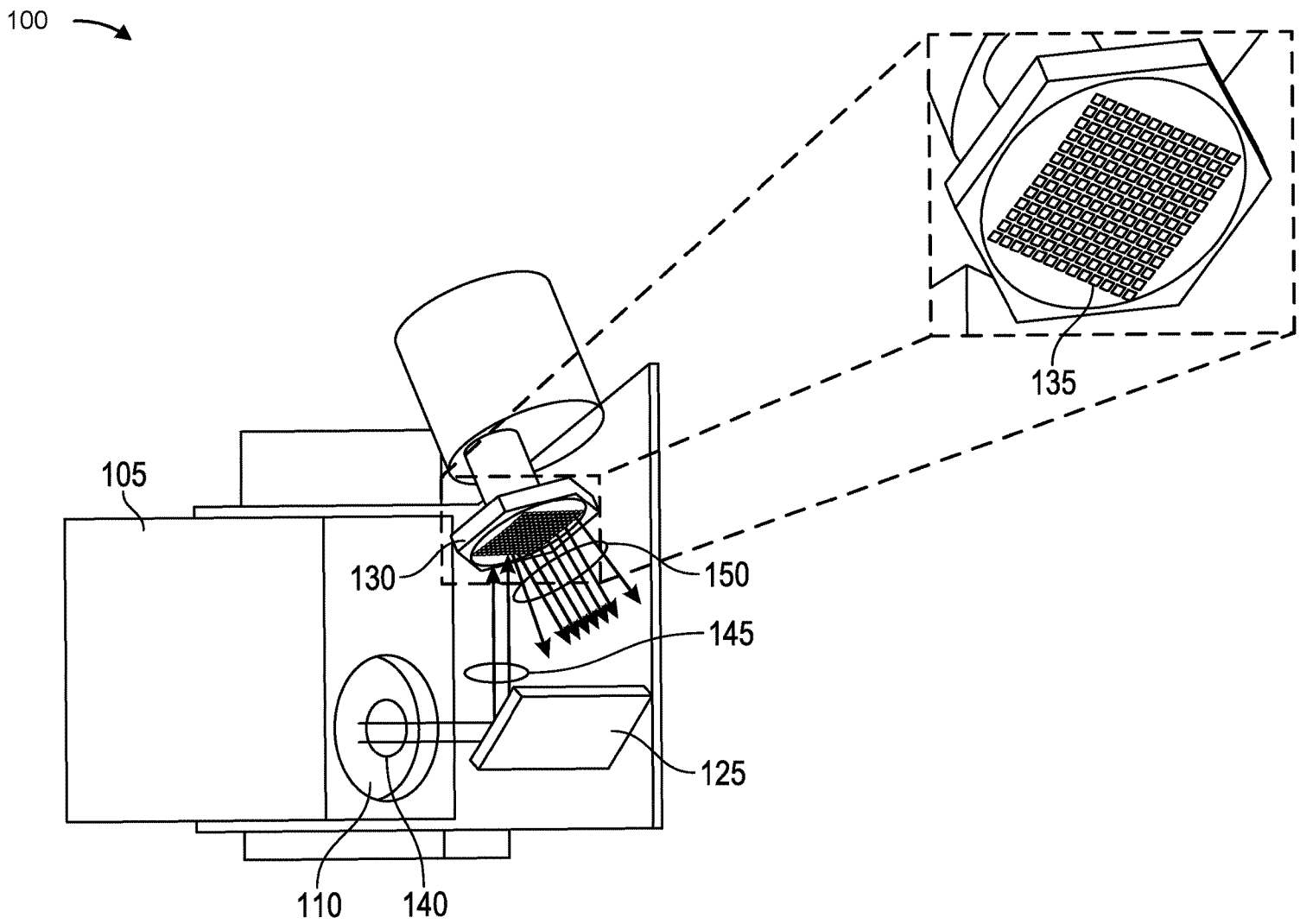
FIG. 2 is a different view of a diagram of an example system described herein

FIG. 2 is a diagram of example system 100 described herein. For example, FIG. 2 is a diagram of a different view of example system 100. Elements of system 100 have been described above in connection with FIG. 1. As shown in FIG. 2, mirror assembly 135 may include a plurality of mirrors. For example, each mirror (of the plurality of mirrors) may have a same shape and a same dimension.

The number and arrangement of devices shown in FIG. 2 are provided as an example. In practice, there may be additional devices, fewer devices, different devices, or differently arranged devices than those shown in FIG. 2. Furthermore, two or more devices shown in FIG. 2 may be implemented within a single device, or a single device shown in FIG. 2 may be implemented as multiple, distributed devices. Additionally, or alternatively, a set of devices (e.g., one or more devices) of the example component may perform one or more functions described as being performed by another set of devices of the example component.

Figure 3:
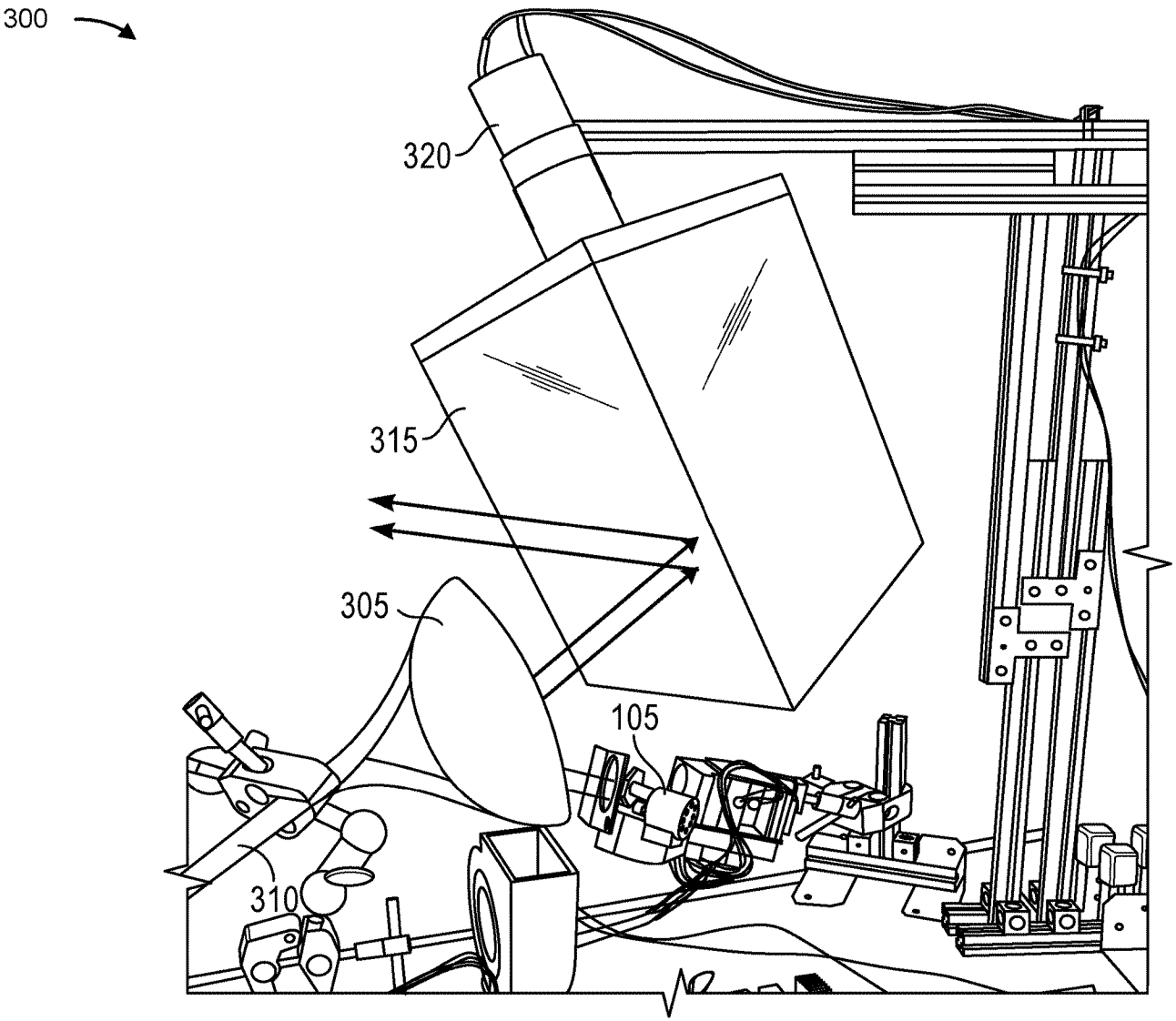
FIG. 3 is a diagram of an example system described herein.

FIG. 3 is a diagram of an example system 300 described herein. As shown in FIG. 3, system 300 may include light source 105, a third reflective component 305, a support structure 310, and a fourth reflective component 315. In some implementations, third reflective component 305 may include a concave mirror. The concave mirror may include mirror assembly 135. As shown in FIG. 3, third reflective component 305 may be supported by support structure 310. In some examples, support structure 310 may comprise spring steel. Support structure 310 may be configured to cause third reflective component 305 to experience a measure of vibration. The measure of vibration may cause light, reflected by third reflective component 305, to be animated. Alternatively to being supported by support structure 310, third reflective component 305 may be supported by another support structure or a combination of structures that cause third reflective component 305 to experience a measure of vibration.

Fourth reflective component 315 may include a rotating component that includes a plurality of reflective surfaces. The plurality of reflective surfaces may include a plurality of mirrors. In some examples, fourth reflective component 315 may be connected to motor 320. Motor 320 may include one or more devices configured to cause fourth reflective component 315 to rotate. A rotational speed of fourth reflective component 315 may be based on an output of motor 320 (e.g., a speed of motor 320). Similarly, a rotational direction of fourth reflective component 315 may be based on an output of motor 320.

In some instances, motor 320 may be connected to a power source (e.g., similar to power source 115) and a controller (e.g., similar to controller 120). The power source may provide power (e.g., electrical power) to motor 320. The controller may control a speed of motor 320. For example, the controller may control revolutions per minute (RPM) of motor 320, which in turn may control a rotational speed of fourth reflective component 315.

As shown in FIG. 3, light source 105 may be directed toward third reflective component 305. Fourth reflective component 315 may be directed toward third reflective component 305. Light source 105 may emit light, in a manner similar to the manner described above in connection with FIG. 1. Third reflective component 305 may receive the light and may reflect (e.g., via mirror assembly 135) the light as a plurality of light elements, in a manner similar to the manner described above in connection with FIG. 1.

Third reflective component 305 may be configured to cause the plurality of light elements to be arranged in a random pattern (as opposed to a geometric pattern generated by a diffraction based laser). For example, the plurality of light elements may be reflected by the concave surface, thereby causing the plurality of elements to be arranged in a random pattern. In some instances, the measure of vibration (experienced by third reflective component 305) may cause the plurality of light elements to be animated (e.g., cause a movement of the plurality of light elements).

Fourth reflective component 315 may receive the plurality of light elements and reflect the plurality of light elements onto a display surface (e.g., similar to display surface 155). A rotation of fourth reflective component 315 may cause a movement of a portion of, or an entirety of, the plurality of light elements.

The number and arrangement of devices shown in FIG. 3 are provided as an example. In practice, there may be additional devices, fewer devices, different devices, or differently arranged devices than those shown in FIG. 3. Furthermore, two or more devices shown in FIG. 3 may be implemented within a single device, or a single device shown in FIG. 3 may be implemented as multiple, distributed devices. Additionally, or alternatively, a set of devices (e.g., one or more devices) of the example component may perform one or more functions described as being performed by another set of devices of the example component.

Figure 4:
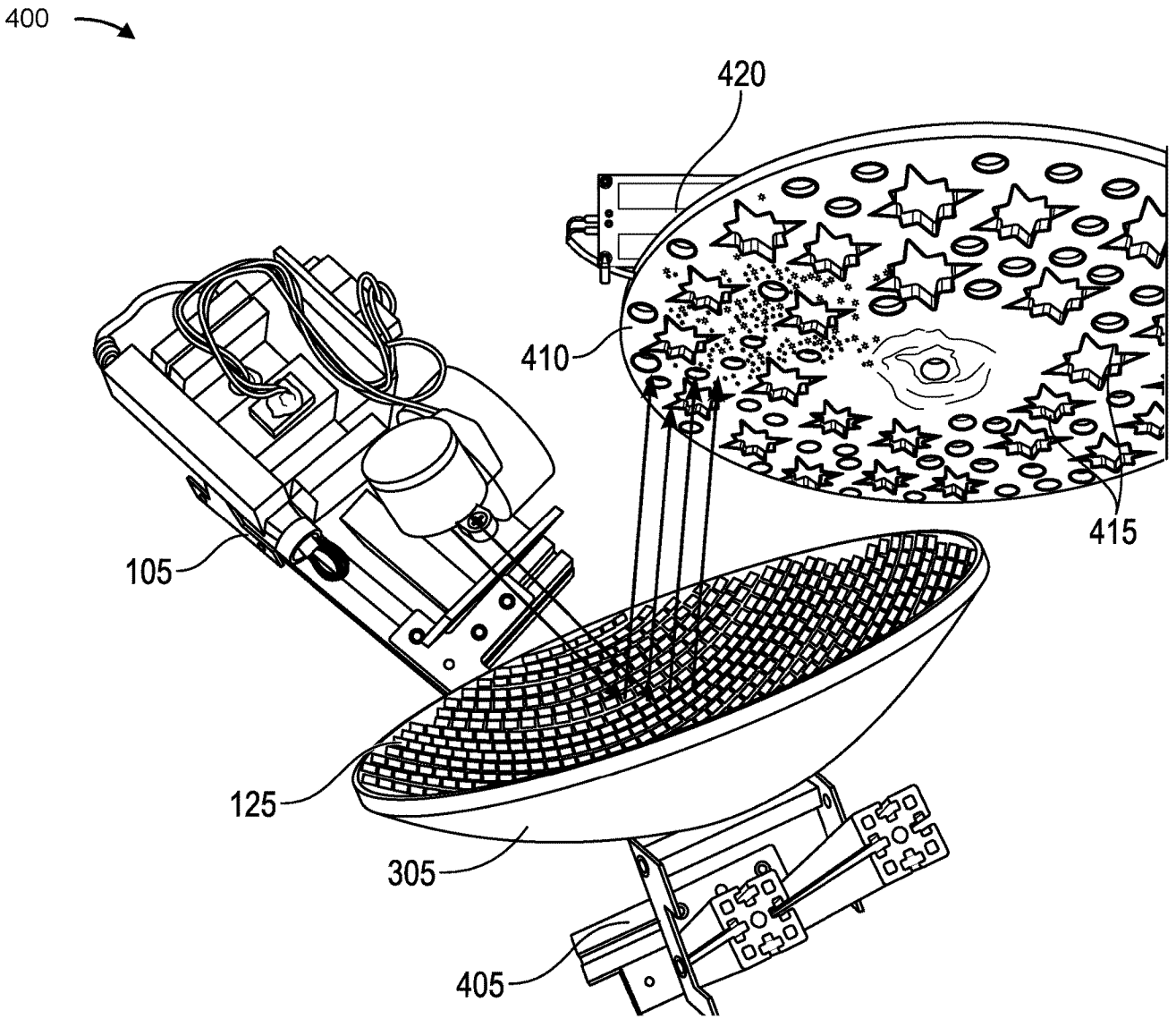
FIG. 4 is a diagram of an example system described herein.

FIG. 4 is a diagram of an example system 400 described herein. Elements of example system 400 have been described above in connection with FIGS. 1 and 3. As shown in FIG. 4, example system 400 may include light source 105, third reflective component 305 (which includes mirror assembly 135), a support structure 405, a component 410, and a controller 420. Support structure 405 may be configured to support third reflective component 305. Component 410 may include a component configured to be rotated, such a disk. As shown in FIG. 4, component 410 may include a first portion configured to enable one or more light elements to pass through and a second portion configured to block one or more lights of the light elements. For example, the first portion may include a plurality of openings 415. As shown in FIG. 4, the plurality of openings 415 may have different sizes and/or different shapes (e.g., stars, circles, squares, among other examples). Alternatively, the plurality of openings 415 may have a same size and/or a same shape.

Component 410 may be connected to a motor (not shown). The motor may include one or more devices configured to cause component 410 to rotate, in a manner similar to the manner described above in connection with FIG. 3. Controller 420 may include one or more devices to control a speed of the motor. For example, controller 420 may control an RPM of the motor.

As shown in FIG. 4, light source 105 may be directed toward third reflective component 305. Component 410 may be directed toward third reflective component 305. Light source 105 may emit light, in a manner similar to the manner described above in connection with FIG. 1. Third reflective component 305 may receive the light and reflect the light (e.g., mirror assembly 135) as a plurality of light elements, in a manner similar to the manner described above in connection with FIG. 1.

Component 410 may receive the plurality of light elements. A rotation of component 410 may cause the first portion to selectively block different light elements. Additionally, the rotation of component 410 may cause the second portion to selectively enable different light elements to pass through and be reflected onto a display surface as a plurality of light points. In this regard, the rotation of component 410 may simulate a blinking effect of the plurality of light points on the display surface.

The number and arrangement of devices shown in FIG. 4 are provided as an example. In practice, there may be additional devices, fewer devices, different devices, or differently arranged devices than those shown in FIG. 4. Furthermore, two or more devices shown in FIG. 4 may be implemented within a single device, or a single device shown in FIG. 4 may be implemented as multiple, distributed devices. Additionally, or alternatively, a set of devices (e.g., one or more devices) of the example component may perform one or more functions described as being performed by another set of devices of the example component.

Figure 5:
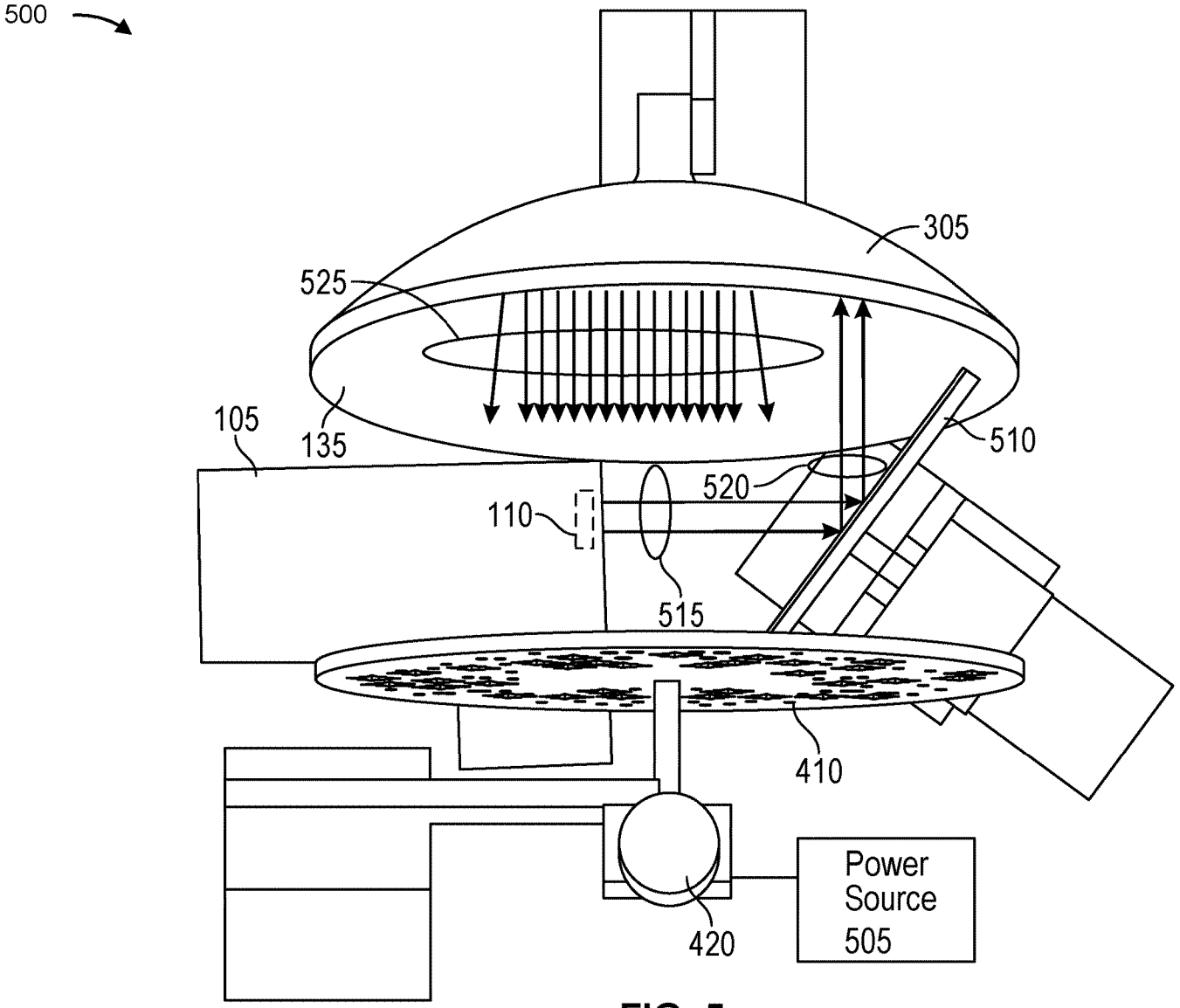
FIG. 5 is a diagram of an example system described herein

FIG. 5 is a diagram of an example system 500 described herein. As shown in FIG. 5, example system 500 may include light source 105, third reflective component 305, component 410, and fourth reflective component 510. Component 410 may be connected to motor 420. Motor 420 may be connected to a power source 505. Power source 505 may be similar to power source 115. Fourth reflective component 510 may be similar to first reflective component 125.

As shown in FIG. 5, light source 105 may be directed toward fourth reflective component 510. Fourth reflective component 510 may directed toward third reflective component 305. Third reflective component 305 may directed toward component 410. Light source 105 may emit light 515, in a manner similar to the manner described above in connection with FIG. 1. Fourth reflective component 510 may receive light 515 and may reflect light 515 as reflected light 520. Third reflective component 305 may receive reflected light 520 and may reflect reflected light 520 as light elements 525, in a manner similar to the manner described above in connection with FIG. 1 and FIG. 3.

In some implementations, reflective element 510 may include a reflective surface that is imperfect with minor rippling. For example, reflective element 510 may be an imperfect mirror. In some examples, the imperfect mirror may comprise Mylar material. For example, the imperfect mirror may be made with a thin piece of Mylar material of thin reflective surface with minor rippling. The imperfection and/or the minor rippling may arrange reflected light 520 and light elements 525 in a slightly random motion. For example, the imperfection and/or the minor rippling may cause reflected light 520 and light elements 525 to be animated.

Component 410 may receive light elements 525. A rotation of component 410 may cause the first portion to selectively block different a portion of light elements 525, in a manner similar to the manner described above in connection with FIG. 4. Additionally, the rotation of component 410 may cause the second portion to selectively enable different light elements 525 to pass through and be reflected onto a display surface (not shown) as a plurality of light points, in a manner similar to the manner described above in connection with FIG. 4. For example, the rotation of component 410 may simulate a blinking effect of the plurality of light points on the display surface.

The number and arrangement of devices shown in FIG. 5 are provided as an example. In practice, there may be additional devices, fewer devices, different devices, or differently arranged devices than those shown in FIG. 5. Furthermore, two or more devices shown in FIG. 5 may be implemented within a single device, or a single device shown in FIG. 5 may be implemented as multiple, distributed devices. Additionally, or alternatively, a set of devices (e.g., one or more devices) of the example component may perform one or more functions described as being performed by another set of devices of the example component.

Figure 6:
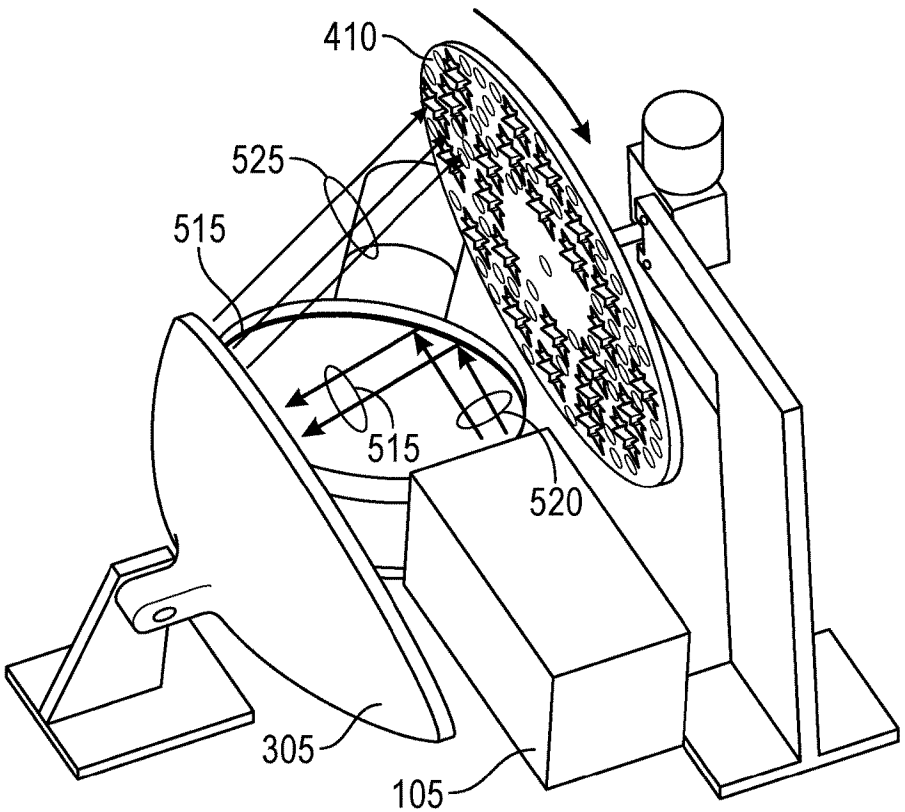
FIG. 6 is a different view of a diagram of an example system described herein.

FIG. 6 is a diagram of example system 500 described herein. For example, FIG. 6 is a diagram of a different view of example system 500. Elements of example system 500 have been described above in connection with FIG. 5. As shown in FIG. 6, light source 105 may be directed toward fourth reflective component 510. Fourth reflective component 510 may directed toward third reflective component 305. Third reflective component 305 may directed toward component 410. Light source 105 may emit light 515, in a manner similar to the manner described above in connection with FIG. 5. Fourth reflective component 510 may receive light 515 and may reflect light 515 as reflected light 520, in a manner similar to the manner described above in connection with FIG. 5. Third reflective component 305 may receive reflected light 520 and may reflect reflected light 520 as light elements 525, in a manner similar to the manner described above in connection with FIG. 5. Component 410 may receive light elements 525. A rotation of component 410 may simulate a blinking effect of the plurality of light points on the display surface.

The number and arrangement of devices shown in FIG. 6 are provided as an example. In practice, there may be additional devices, fewer devices, different devices, or differently arranged devices than those shown in FIG. 6. Furthermore, two or more devices shown in FIG. 6 may be implemented within a single device, or a single device shown in FIG. 6 may be implemented as multiple, distributed devices. Additionally, or alternatively, a set of devices (e.g., one or more devices) of the example component may perform one or more functions described as being performed by another set of devices of the example component.

Implementations described herein are directed to a system that generates a plurality of light elements based on a coherent light beam, of an RGB laser, that is reflected by a plurality of mirrors. The laser may be fully RGB controllable, thereby enabling each light element to be generated according to a desired color. Additionally, each light element may be classified as a Class 1 laser due to a reduced amount of energy of the light element. Furthermore, the system may include a combination of components to cause the plurality of light elements to be provided according to different shapes and/or sizes and to be animated. In some examples, the system may include light source 105 directed toward a disk of lenses. The disk may be configured to rotate and/or may be supported by a support structure comprising spring steel.

The system may provide a video like motion for the plurality of light elements while maintaining a brightness and quality of a coherent light generated by a laser. The different elements of the system may be configured to cause the plurality of light elements to simulate star fields, fireflies, pixie dust, among other examples.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations may not be combined.

As used herein, the term "component" is intended to be broadly construed as hardware, firmware, and/or a combination of hardware and software. It will be apparent that systems and/or methods described herein may be implemented in different forms of hardware, firmware, or a combination of hardware and software. The actual specialized control hardware or software code used to implement these systems and/or methods is not limiting of the implementations. Thus, the operation and behavior of the systems and/or methods are described herein without reference to specific software code—it being understood that software and hardware can be designed to implement the systems and/or methods based on the description herein.

As used herein, a "wavelength" is intended to be construed as a range or band of wavelengths perceived as a single color. The actual range of wavelengths will be determined by the capabilities of the light source producing the light.

As used herein, satisfying a threshold may, depending on the context, refer to a value being greater than the threshold, greater than or equal to the threshold, less than the threshold, less than or equal to the threshold, equal to the threshold, not equal to the threshold, or the like.

Even though particular combinations of features are recited in the claims and/or disclosed in the specification, these combinations are not intended to limit the disclosure of various implementations. In fact, many of these features may be combined in ways not specifically recited in the claims and/or disclosed in the specification. Although each dependent claim listed below may directly depend on only one claim, the disclosure of various implementations includes each dependent claim in combination with every other claim in the claim set. As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiple of the same item.

No element, act, or instruction used herein should be construed as critical or essential unless explicitly described as such. Also, as used herein, the articles "a" and "an" are intended to include one or more items, and may be used interchangeably with "one or more." Further, as used herein, the article "the" is intended to include one or more items referenced in connection with the article "the" and may be used interchangeably with "the one or more." Furthermore, as used herein, the term "set" is intended to include one or more items (e.g., related items, unrelated items, or a combination of related and unrelated items), and may be used interchangeably with "one or more." Where only one item is intended, the phrase "only one" or similar language is used. Also, as used herein, the terms "has," "have," "having," or the like are intended to be open-ended terms. Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. A system, comprising:

a laser light source configured to emit light;

a first reflective component configured to reflect the light, emitted by the laser light source, as reflected flight; and a second reflective component configured to reflect the reflected light as a plurality of light elements that are reflected onto a display surface, wherein the second reflective component includes a plurality of mirrors, wherein each mirror, of the plurality of mirrors, is configured to reflect a portion of the reflected light as a respective light element of the plurality of light elements, wherein a first light element, of the plurality of light elements, is reflected onto a first location of the display surface, and wherein a second light element, of the plurality of light elements, is reflected onto a second location, of the display surface, that is different than the first location.

2. The system of claim 1, wherein a shape of a first mirror, of the plurality of mirrors, is same as a shape of a second mirror of the plurality of mirrors.

3. The system of claim 1, wherein a size of a first mirror, of the plurality of mirrors, is same as a size of a second mirror of the plurality of mirrors.

4. The system of claim 1, wherein a size of a first mirror, of the plurality of mirrors, is different than a size of a second mirror of the plurality of mirrors.

5. The system of claim 1, wherein a shape of a first mirror, of the plurality of mirrors, is different than a shape of a second mirror of the plurality of mirrors.

6. The system of claim 1, wherein each light element, of the plurality of light elements, is classified as a Class 1 laser.

7. The system of claim 6, wherein the light emitted by the laser is a red-green-blue (RGB) light, and wherein the system further comprises a controller configured to control a wavelength of each component of the RGB light.

8. A system, comprising:

a light source configured to emit light; and a first component including a reflective surface configured to reflect the light as a plurality of light elements that are reflected onto a second component, wherein the reflective surface includes a plurality of mirrors, wherein each mirror, of the plurality of mirrors, is configured to reflect a portion of the light as a respective light element of the plurality of light elements, wherein a first light element, of the plurality of light elements, is reflected onto a first location of the surface, and wherein a second light element, of the plurality of light elements, is reflected onto a second location, of the surface, that is different than the first location.

9. The system of claim 8, wherein the reflective surface is a concave surface.

10. The system of claim 8, further comprising the second component, wherein the second component includes a disk, wherein the disk includes a first portion configured to enable one or more first light elements, of the plurality of light elements, to pass through and a second portion configured to block one or more second lights of the plurality of light elements, and wherein the first portion include a plurality of openings.

11. The system of claim 10, wherein the light source includes a laser, and wherein each light element is classified as a Class 1 laser.

12. The system of claim 10, wherein a shape of a first opening, of the plurality of openings, is different than a shape of a second opening of the plurality of openings.

13. The system of claim 8, further comprising the second component, wherein the second component is a rotating component that includes a plurality of reflective surfaces.

14. The system of claim 13, wherein the plurality of reflective surfaces includes a plurality of mirrors.

15. A system, comprising:

a light source configured to emit light; and a first component configured to reflect the light as a plurality of light elements that are reflected onto a second component, wherein the first component includes a plurality of reflective components, wherein each reflective component, of the plurality of reflective components, is configured to reflect a portion of the light as a respective light element of the plurality of light elements, wherein a first light element, of the plurality of light elements, is reflected onto a first location on the second component, and wherein a second light element, of the plurality of light elements, is reflected onto a second location, on the second component, that is different than the first location.

16. The system of claim 15, wherein the light source includes a laser, and wherein each light element, of the plurality of light elements, is classified as a Class 1 laser.

17. The system of claim 16, wherein the light emitted by the laser is a red-green-blue (RGB) light, and wherein the system further comprises a controller configured to control a wavelength of each component of the RGB light.

18. The system of claim 15, wherein the plurality of reflective components includes a plurality of mirrors, and wherein a size of a first mirror, of the plurality of mirrors, is same as a size of a second mirror of the plurality of mirrors.

19. The system of claim 15, wherein the plurality of reflective components includes a plurality of mirrors, and wherein a size of a first mirror, of the plurality of mirrors, is different than a size of a second mirror of the plurality of mirrors.

20. The system of claim 15, further comprising the second component, wherein the second component includes a disk configured to be rotated, wherein the disk includes a first portion configured to enable one or more first light elements, of the plurality of light elements, and a second portion configured to block one or more second lights of the plurality of light elements, and wherein the first portion include a plurality of openings.

* * * * *